US012304024B2

(12) United States Patent
Fuwa et al.

(10) Patent No.: US 12,304,024 B2
(45) Date of Patent: May 20, 2025

(54) POLISHING TOOL

(71) Applicant: DISCO CORPORATION, Tokyo (JP)

(72) Inventors: Naruto Fuwa, Tokyo (JP); Naoya Sukegawa, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 0 days.

(21) Appl. No.: 17/805,156

(22) Filed: Jun. 2, 2022

(65) Prior Publication Data

US 2022/0395957 A1 Dec. 15, 2022

(30) Foreign Application Priority Data

Jun. 14, 2021 (JP) ..... 2021-098441

(51) Int. Cl.
*B24B 37/22* (2012.01)

(52) U.S. Cl.
CPC ..... *B24B 37/22* (2013.01)

(58) Field of Classification Search
CPC ..... B24B 37/20; B24B 37/22; B24B 37/24; B24B 37/14; B24B 37/26; B24B 37/245; B24D 3/002; B24D 3/00; B24D 3/34; B24D 3/342; B24D 3/344; B24D 3/346; B24D 3/348; B24D 11/00
USPC ..... 451/526, 527, 532, 533, 534, 535, 536, 451/539
See application file for complete search history.

(56) References Cited

U.S. PATENT DOCUMENTS 4,969,914 A * 11/1990 Ikegaya ..... B24B 13/015 451/354
8,435,098 B2 * 5/2013 You ..... B24D 11/00 451/526
2003/0114087 A1 * 6/2003 Duboust ..... B23H 5/08 451/41
2004/0055223 A1 * 3/2004 Ono ..... B24D 3/28 51/293
2004/0231245 A1 * 11/2004 Yamamoto ..... B24D 3/00 51/296
2007/0232200 A1 10/2007 Natsui et al.
2011/0080987 A1 4/2011 Watanabe et al.
2014/0227951 A1 8/2014 Lin et al.
(Continued)

FOREIGN PATENT DOCUMENTS

CN 111318956 A * 6/2020 ..... B24B 37/24
JP S56026868 U 3/1981
(Continued)

OTHER PUBLICATIONS

JP 2008114350—Machine Translation (Year: 2008).*
(Continued)

*Primary Examiner* — Brian D Keller
*Assistant Examiner* — Alberto Saenz
(74) *Attorney, Agent, or Firm* — GREER BURNS & CRAIN, LTD.

(57) ABSTRACT

There is provided a polishing tool for polishing a wafer. The polishing tool includes a base and a polishing layer fixed to the base. The polishing layer includes an electrically conductive material dispersed therein to eliminate static electricity generated when the polishing layer comes into contact with the wafer. Preferably, the electrically conductive material is carbon fiber, and the carbon fiber is included at a content of 3 wt % or more but 15 wt % or less.

19 Claims, 8 Drawing Sheets

(56) References Cited

U.S. PATENT DOCUMENTS

| | | | |
|---|---|---|---|
| 2020/0198092 | A1 | 6/2020 | Kim |
| 2020/0215663 | A1 | 7/2020 | Kim |
| 2022/0088746 | A1 | 3/2022 | Tsuda |

FOREIGN PATENT DOCUMENTS

| | | | | | |
|---|---|---|---|---|---|
| JP | H06246639 | A | | 9/1994 | |
| JP | 2000288881 | A | | 10/2000 | |
| JP | 2066000950 | A | | 1/2006 | |
| JP | 2008114350 | A | * | 5/2008 | |
| JP | 2008229761 | A | | 10/2008 | |
| JP | 2015055307 | A | | 3/2015 | |
| JP | 2016107075 | A | | 6/2016 | |
| JP | 6779541 | B1 | * | 11/2020 | ..... B24D 3/06 |
| WO | 2009128250 | A1 | | 10/2009 | |
| WO | 2021002216 | A1 | | 1/2021 | |

OTHER PUBLICATIONS

CN 111318956—Machine Translation (Year: 2020).*
JP-6779541—Machine Translation (Year: 2020).*
Search Report issued by the Intellectual Property Office of Singapore in copending Singapore Application No. 10202205320S, dated Oct. 31, 2023.
Office Action issued by the Japanese Patent Office in corresponding JP Application No. 2021-098441, dated 1 Nov. 7, 2024.
Office Action issued by the Japanese Patent Office in corresponding JP Application No. 2021-098441, dated Feb. 26, 2025.

* cited by examiner

POLISHING TOOL

BACKGROUND OF THE INVENTION

Field of the Invention

The present invention relates to a polishing tool for polishing a wafer.

Description of the Related Art

A device chip fabrication process uses a wafer with devices formed in respective regions which are defined by a plurality of streets (projected dicing lines) arranged in a grid pattern. By dividing the wafer along the streets, a plurality of device chips including the respective devices are obtained. Such device chips are incorporated in various electronic appliances such as mobile phones and personal computers.

With ongoing downsizing of electronic appliances in recent years, there is an increasing demand for thinner device chips. A wafer may hence be subjected to thinning processing using a grinding apparatus before its division. The grinding apparatus includes a chuck table that holds a workpiece and a grinding unit that grinds the workpiece. On the grinding unit, a grinding wheel including grinding stones is mounted. The wafer is held on the chuck table, and the grinding stones are brought into contact with the wafer while the chuck table and the grinding wheel are being rotated, so that the wafer is ground and thinned (see Japanese Patent Laid-open No. 2000-288881).

On a surface (ground surface) of the wafer ground by the grinding stones, fine scratches (grinding marks, saw marks) formed along paths of the grinding stones are left. If the wafer in this state is divided to fabricate device chips, grinding marks remain on the device chips, and the device chips are lowered in flexural strength (bending strength). Therefore, polishing is applied to the wafer after the grinding. This polishing is performed using a disc-shaped polishing tool (polishing pad) that includes a polishing layer to be brought into contact with the wafer. By pressing the polishing layer against the ground surface of the wafer while rotating the polishing tool, the ground surface is planarized, and the grinding marks remaining on the ground surface are removed. However, the polishing of the wafer with the polishing tool may lead to generation of static electricity between the mutually contacting wafer and polishing layer, and the wafer may be charged on a side of the surface (polished surface) thereof polished by the polishing layer. As a result, the devices formed on the wafer may undergo a breakdown and encounter an operational failure, thereby raising a problem that the device chips may be lowered in quality.

To cope with the above-described problem, Japanese Patent Laid-open No. 2008-114350 discloses a method that polishes a wafer by using a polishing tool which includes a polishing layer with cylindrical, static electricity eliminating portions embedded therein. In the polishing tool, the static electricity eliminating portions are exposed at a lower surface of the polishing layer, and during polishing of the wafer, the static electricity eliminating portions are in contact with the surface being polished of the wafer. As a consequence, static electricity generated by the contact between the wafer and the polishing layer is eliminated via the static electricity eliminating portions, so that breakdowns and operational failures of devices by static electricity are minimized.

SUMMARY OF THE INVENTION

As mentioned above, static electricity generated during polishing can be eliminated using a polishing tool with static electricity eliminating portions embedded in a polishing layer. However, the material of the static electricity eliminating portions is different from the material of a matrix of the polishing layer, and therefore, during polishing of a wafer, the polishing layer may be prone to wearing in regions with the static electricity eliminating portions disposed therein compared with the remaining regions. If this is the case, polishing of wafers with the polishing tool for a certain period of time leads to a reduction in thickness in the regions with the static electricity eliminating portions disposed therein compared with the remaining regions, making it difficult for the static electricity eliminating portions to come into contact with the wafer. As a result, the static electricity eliminating effect cannot be exhibited sufficiently, leading to a problem that the occurrence of breakdowns and operational failures of devices may not be suppressed.

With the foregoing problem in view, the present invention has as an object thereof the provision of a polishing tool which can ensure elimination of static electricity generated by polishing of a wafer.

In accordance with an aspect of the present invention, there is provided a polishing tool for polishing a wafer, which includes a base and a polishing layer fixed to the base. The polishing layer includes an electrically conductive material dispersed therein to eliminate static electricity generated when the polishing layer comes into contact with the wafer.

Preferably, the electrically conductive material may be carbon fiber, and the carbon fiber may be included at a content of 3 wt % or more but 15 wt % or less.

The polishing tool according to the aspect of the present invention includes the polishing layer with the electrically conductive material dispersed therein. Owing to this configuration, the conductive material remains in contact with the wafer during polishing of the wafer by the polishing tool, so that elimination of static electricity generated between the wafer and the polishing layer can be ensured.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
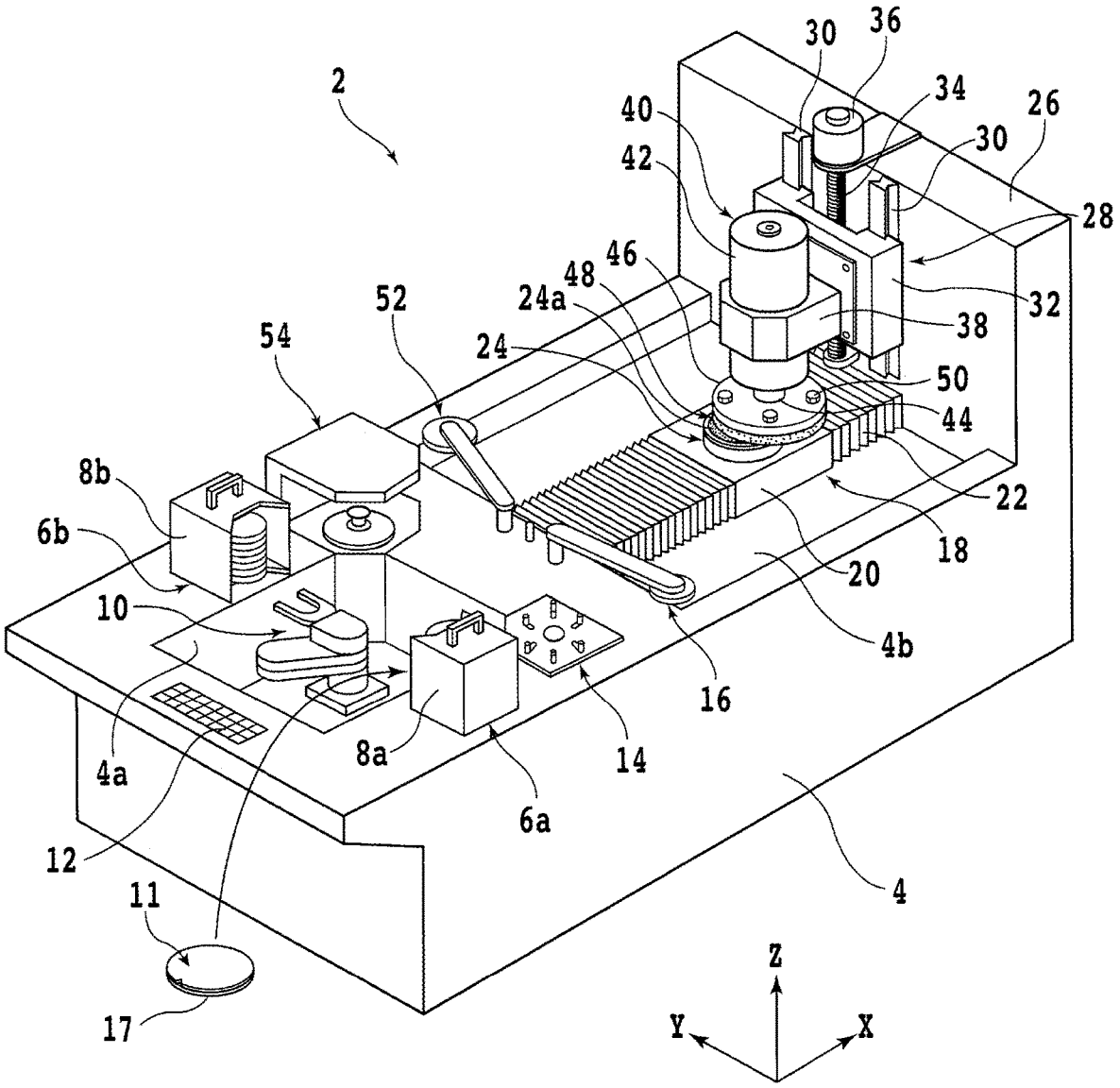
FIG. 1 is a perspective view illustrating a polishing apparatus.

With reference to the attached drawings, an embodiment of the present invention will be described hereinafter. First, a description will be made about a configuration example of a polishing apparatus that can polish a wafer with use of a polishing tool according to the embodiment. FIG. 1 is a perspective view illustrating a polishing apparatus 2. It is to be noted that, in FIG. 1, an X-axis direction (first horizontal direction, front-and-rear direction) and a Y-axis direction (second horizontal direction, left-and-right direction) are orthogonal to each other in the same plane (X-Y plane). On the other hand, a Z-axis direction (vertical direction, up-and-down direction, height direction) is a direction that is orthogonal to the X-axis direction and the Y-axis direction.

The polishing apparatus 2 includes a rectangular parallelepiped bed 4 on or in which individual components of the polishing apparatus 2 are supported or accommodated. On a front end section of the bed 4, cassette mounting regions (cassette mounting tables) 6*a* and 6*b* are disposed to mount cassettes 8*a* and 8*b*. The cassettes 8*a* and 8*b* are containers in each of which a plurality of wafers 11 can be accommodated, and are arranged in the cassette mounting regions 6*a* and 6*b*, respectively. For example, wafers 11 to be polished are placed in the cassette 8*a*, and polished wafers 11 are placed in the cassette 8*b*.

Figure 2:
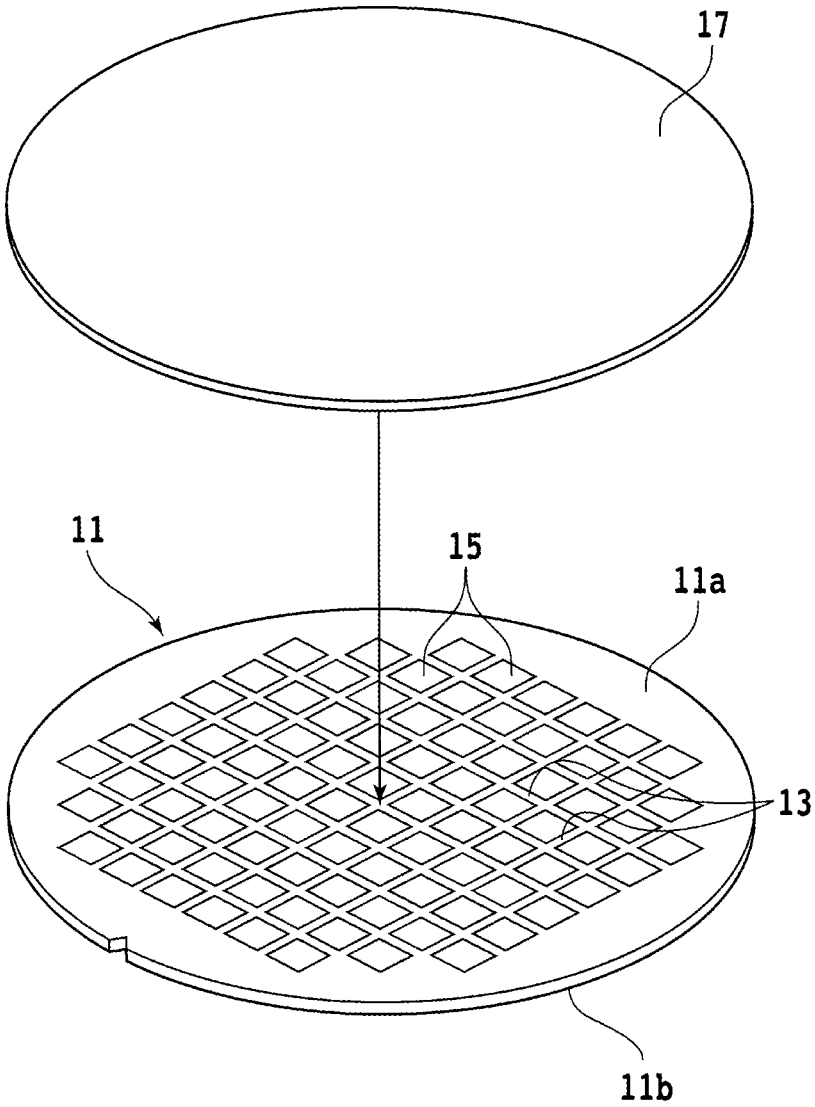
FIG. 2 is a perspective view illustrating a wafer.

FIG. 2 is a perspective view illustrating one of the wafers 11. The wafer 11 is, for example, a disc-shaped single-crystal wafer made of a semiconductor material such as silicon and includes a front surface 11*a* and a back surface 11*b* which are substantially parallel to each other. The wafer 11 is defined into a plurality of rectangular regions by a plurality of streets (projected dicing lines) 13 arrayed in such a grid pattern that the streets 13 intersect one another. On the front surface 11*a* in the regions defined by the streets 13, respective devices 15 such as integrated circuits (ICs), large scale integration (LSI) circuits, light emitting diodes (LEDs), or micro electro mechanical systems (MEMS) devices are formed. However, no limitations are imposed on the type, material, shape, structure, size, and the like of the wafer 11. For example, the wafer 11 may be a wafer made of a semiconductor other than silicon (GaAs, InP, GaN, SiC, or the like), sapphire, glass, ceramics resin, metal, or the like. Further, no limitations are imposed on the type, number, shape, structure, size, arrangement, and the like of the devices 15.

By dividing the wafer 11 along the streets 13, a plurality of device chips which include the respective devices 15 are fabricated. Further, thin device chips are obtained by grinding and thinning the wafer 11 on a side of the back surface 11*b* thereof with use of grinding stones before the division of the wafer 11.

On the back surface 11*b* (ground surface) of the wafer 11 ground by the grinding stones, fine scratches (grinding marks, saw marks) formed along paths of the grinding stones are left. If the wafer 11 in this state is divided to fabricate device chips, grinding marks remain on the device chips, and the device chips are lowered in flexural strength (bending strength). To avoid this, after the grinding, the wafer 11 is polished on the side of the back surface 11*b* thereof with use of the polishing apparatus 2 (see FIG. 1). By the polishing, the wafer 11 is planarized on the side of the back surface 11*b* thereof, and the grinding marks remaining on the side of the back surface 11*b* of the wafer 11 are removed.

When polishing is to be performed on the wafer 11 on the side of the back surface 11*b* thereof by the polishing apparatus 2, a protective member 17 is adhered to a side of the front surface 11*a* of the wafer 11. As the protective member 17, a tape of substantially the same shape and size as the wafer 11 is used, for example. The tape includes a film-shaped base material having flexibility and an adhesive layer (glue layer) applied on the base material. The base material is formed of resin such as polyolefin, polyvinyl chloride, or polyethylene terephthalate while the adhesive layer is formed of an epoxy-based, acrylic, or rubber-based adhesive or the like. The adhesive layer may also be formed of ultraviolet-curable resin that is cured by irradiation with ultraviolet rays. With protective members 17 adhered on the wafers 11, the wafers 11 are placed in the cassette 8*a* illustrated in FIG. 1. The cassette 8*a* with the wafers 11 placed therein is mounted in the cassette mounting region 6*a*.

In a region located between the cassette mounting regions 6*a* and 6*b* on a side of an upper surface of the bed 4, a recessed section 4*a* is disposed. Inside the recessed section 4*a*, a first transfer mechanism 10 is disposed to transfer the wafer 11. In a region in front of the recessed section 4*a*, a control panel 12 is disposed to input various kinds of information (processing conditions and the like) to the polishing apparatus 2. Obliquely in rear of the first transfer mechanism 10, a position adjusting mechanism 14 is disposed to adjust the position of the wafer 11. One of the wafers 11 placed in the cassette 8*a* is transferred onto the position adjusting mechanism 14 by the first transfer mechanism 10. The position adjusting mechanism 14 then adjusts the position of the wafer 11 by grasping the wafer 11. In a vicinity of the position adjusting mechanism 14, a second transfer mechanism (loading arm) 16 is arranged turnably with the wafer 11 held.

In a region located in rear of the second transfer mechanism 16 on the side of the upper surface of the bed 4, a rectangular recessed portion 4*b* is disposed. The rectangular recessed portion 4*b* is formed such that its longitudinal direction conforms to the X-axis direction. A moving mechanism 18 is disposed inside the rectangular recessed portion 4*b*. The moving mechanism 18 is, for example, a ball-screw type moving mechanism and includes a ball screw (not illustrated) arranged along the X-axis direction, a pulse motor (not illustrated) that rotates the ball screw, and the like. The moving mechanism 18 also includes a planar movable table 20 and moves the movable table 20 along the X-axis direction. In front and rear of the movable table 20, bellows-shaped dust and splash covers 22 are disposed in such a manner that the dust and splash covers 22 cover the components (ball screw, pulse motor, and the like) of the moving mechanism 18 and expand and contract along the X-axis direction.

On the movable table 20, a chuck table (holding table) 24 is disposed to hold the wafer 11. The chuck table 24 has an upper surface, which is a planar surface substantially parallel to the horizontal direction (X-Y plane direction) and constitutes a holding surface 24*a* to hold the wafer 11 thereon. The holding surface 24*a* is connected to a suction source (not illustrated) such as an ejector via a suction channel 24*b* (see FIG. 6) formed inside the chuck table 24, a valve (not illustrated), and the like. The wafer 11 which has been adjusted in position by the position adjusting mechanism 14 is transferred onto the holding surface 24*a* of the chuck table 4 by the second transfer mechanism 16 and is held under suction on the chuck table 24. When the movable table 20 is moved by the moving mechanism 18, the chuck table 24 is moved together with the movable table 20 along the X-axis direction. To the chuck table 24, a rotary drive source (not illustrated) such as a motor is connected to rotate the chuck table 24 about an axis of rotation that is substantially parallel to the Z-axis direction.

On a rear end section of the bed 4, a rectangular parallelepiped support structure 26 is disposed. On a side of a front surface of the support structure 6, a moving mechanism 28 is disposed. The moving mechanism 28 includes a pair of guide rails 30 arranged along the Z-axis direction on the side of the front surface of the support structure 26. On the paired guide rails 30, a movable plate 32 is mounted slidably along the guide rails 30. On a side of a rear surface (on a side of a back surface) of the movable plate 32, a nut portion (not illustrated) is disposed. In threaded engagement with the nut portion, a ball screw 34 is arranged along the Z-axis direction between the paired guide rails 30. A pulse motor 36 is connected to an end portion of the ball screw 34. When the ball screw 34 is rotated by the pulse motor 36, the movable plate 32 is moved in the Z-axis direction along the guide rails 30. On a side of a forward surface (on a side of a front surface) of the movable plate 32, a support member 38 is disposed. The support member 38 supports a polishing unit 40 that applies polishing to the wafer 11.

The polishing unit 40 includes a hollow cylindrical housing 42 supported by the support member 38. In the housing 42, a cylindrical spindle 44 is rotatably accommodated extending along the Z-axis direction. The spindle 44 is exposed at a distal end portion (lower end portion) thereof to an outside of the housing 42, and a rotary drive source (not illustrated) such as a motor is connected to a proximal end portion (upper end portion) of the spindle 44. On the distal end portion of the spindle 44, a disc-shaped mount 46 is fixed. On a side of a lower surface of the mount 46, a disc-shaped polishing tool (polishing pad) 48 is mounted to polish the wafer 11. The polishing tool 48 is, for example, fixed to the mount 46 by fixtures such as bolts 50. The polishing tool 48 is rotated about an axis of rotation, which is generally parallel to the Z-axis direction, by power transmitted from the rotary drive source via the spindle 44 and the mount 46. The chuck table 24 with the wafer 11 held thereon is positioned underneath the polishing unit 40 by the moving mechanism 18. The polishing unit 40 is then lowered at a predetermined speed by the moving mechanism 28 while the chuck table 24 and the spindle 44 are being rotated. As a consequence, the rotating polishing tool 48 comes into contact with the wafer 11, and the wafer 11 is polished.

At a position adjacent the second transfer mechanism 16, a third transfer mechanism (unloading arm) 52 is arranged turnably with the wafer 11 held thereon. On a side forward of the third transfer mechanism 52, a cleaning system 54 is arranged to clean the wafer 11. The cleaning system 54 includes, for example, a spinner table that rotates with the wafer 11 held thereon and a nozzle that supplies a cleaning fluid such as pure water to the wafer 11 held on the spinner table. The wafer 11 which has been polished by the polishing unit 40 is transferred to the cleaning system 54 by the third transfer mechanism 52 and is cleaned by the cleaning system 54. The wafer 11 after its cleaning is then transferred by the first transfer mechanism 10 and placed into the cassette 8*b*.

Figure 3A:
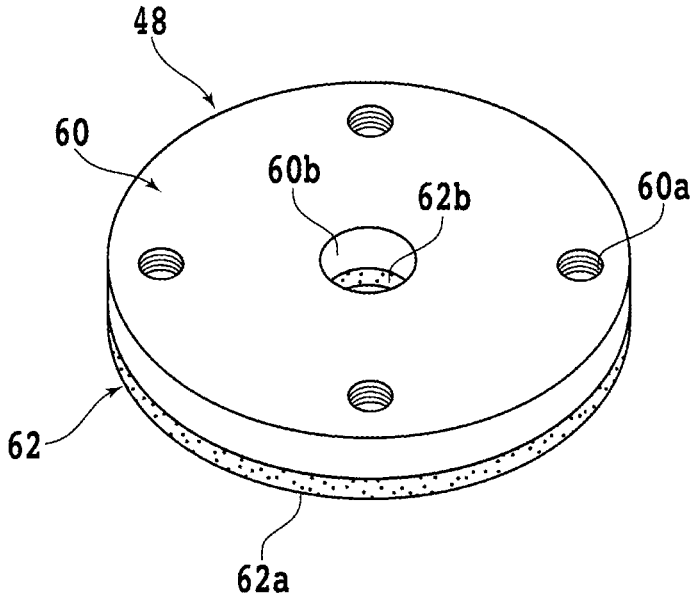
FIG. 3A is a perspective view illustrating a side of an upper surface of a polishing tool according to an embodiment of the present invention.
Figure 3B:
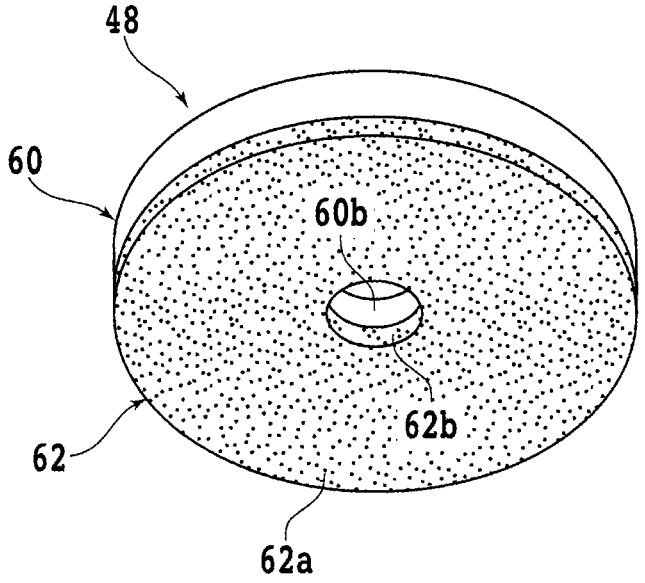
FIG. 3B is a perspective view illustrating a side of a bottom surface of the polishing tool of FIG. 3A.

When polishing is to be performed on the wafer 11 by the polishing apparatus 2, the polishing tool 48 is mounted on the mount 46. FIG. 3A is a perspective view illustrating a side of an upper surface of the polishing tool 48. FIG. 3B is a perspective view illustrating a side of a bottom surface of the polishing tool 48. The polishing tool 48 includes a disc-shaped base 60 and a disc-shaped polishing layer 62 fixed to the base 60.

The base 60 is made from metal such as stainless steel or aluminum and has a plurality of screw holes 60*a* that are open on a side of an upper surface of the base 60. The screw holes 60*a* are arrayed at substantially equal intervals along a peripheral direction of the base 60. In a central portion of the base 60, a cylindrical through-hole 60*b* is defined extending through the base 60 in its thickness direction. The polishing layer 62 is formed in a disc shape of substantially the same diameter as the base 60 and is joined to a side of a lower surface of the base 60 with an adhesive or the like. The polishing layer 62 constitutes at a lower surface thereof a planar polishing surface 62*a* that is brought into contact with the wafer 11 to polish the wafer 11. In a central portion of the polishing layer 62, a cylindrical through-hole 62*b* is defined extending through the polishing layer 62 in its thickness direction. With the upper surface of the base 60 maintained in contact with the lower surface of the mount 46 (see FIG. 1), the bolts 50 (see FIG. 1) are inserted and screwed into the screw holes 60*a* via through-holes (not illustrated) defined in the mount 46, so that the polishing tool 48 is mounted on the mount 46.

Figure 4:
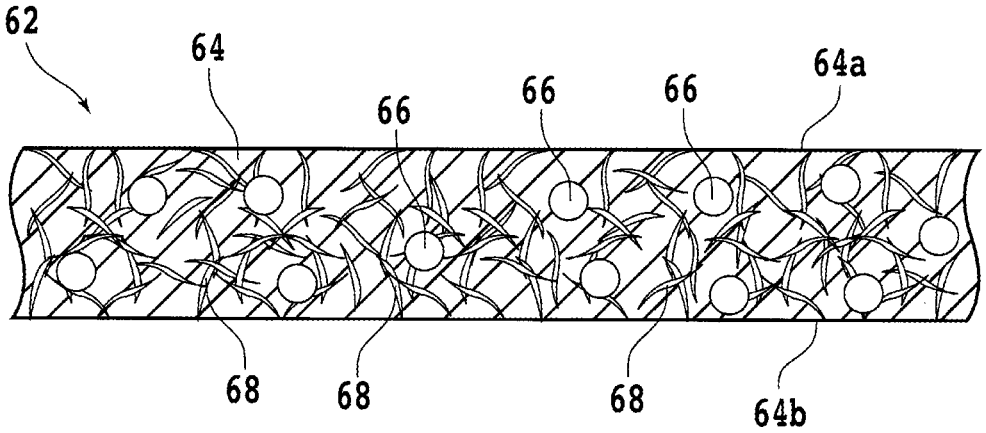
FIG. 4 is an enlarged fragmentary cross-sectional view illustrating a polishing layer of the polishing tool of FIGS. 3A and 3B.

FIG. 4 is an enlarged fragmentary cross-sectional view illustrating the polishing layer 62. The polishing layer 62 includes a binder (base material) layer 64 as a matrix of the polishing layer 62, and abrasive grains (fixed abrasive grains) 66 and an electrically conductive material 68, both contained in the binder layer 64. It is to be noted that, for the sake of convenience of description, the abrasive grains 66 and the electrically conductive material 68 are illustrated on an enlarged scale relative to a thickness of the binder layer 64.

The binder layer 64 is a disc-shaped member that functions as a bond to fix the abrasive grains 66, and has an upper surface 64*a* and a lower surface 64*b* which are substantially parallel to each other. It is to be noted that the lower surface 64*b* of the binder layer 64 corresponds to the polishing surface 62*a* (see FIGS. 3A and 3B) of the polishing layer 62. For example, the binder layer 64 is made from felt, resin (urethane foam, rubber particles, or the like), or the like and has a thickness set to 5 mm or greater but 15 mm or smaller. As the abrasive grains 66, silica ($SiO_2$) having an average grain size of 1 μm or greater but 10 μm or smaller is used, for example. However, the material and thickness of the binder layer 64 and the material and grain size of the abrasive grains 66 can appropriately be changed according to the material and the like of the wafer 11 to be polished.

Further, the electrically conductive material 68 is substantially uniformly dispersed in the polishing layer 62 (binder layer 64). A portion of the electrically conductive material 68 is exposed on the upper surface 64*a* of the binder layer 64, and another portion of the electrically conductive material 68 is exposed on the lower surface 64*b* of the binder layer 64. In addition, the electrically conductive material 68 exposed on the upper surface 64*a* and the electrically conductive material 68 exposed on the lower surface 64*b* are connected together via the electrically conductive material 68 embedded inside the binder layer 64. Accordingly, electrically conductive paths are formed extending from the upper surface 64*a* to the lower surface 64*b* of the binder layer 64, so that the polishing layer 62 has electrical conductivity in the thickness direction of the polishing layer 62 (in a thickness direction of the binder layer 64). The electrically conductive material 68 functions to eliminate static electricity generated during contact of the polishing layer 62 with the wafer 11. As the electrically conductive material 68, carbon fibers can be used. For example, carbon fibers having an average length (average fiber length) of 1 μm or longer but 20 μm or shorter and an average diameter (average fiber diameter) of 0.1 μm or greater but 0.5 μm or smaller are used. Further, the carbon fibers are contained at a content adjusted such that electrically conductive paths are appropriately formed extending from the upper surface 64*a* to the lower surface 64*b* of the binder layer 64. Described specifically, the content of the carbon fibers may preferably be 3 wt % or more but 15 wt % or less. This content is equivalent to the proportion of the mass of the carbon fibers to the mass of the polishing layer 62 including the abrasive grains 66 (the sum of the mass of the binder layer 64, the mass of the abrasive grains 66, and the mass of the carbon fibers).

For example, felt with the abrasive grains 66 and the carbon fibers dispersed therein is obtained by impregnating the felt with liquid, in which the abrasive grains 66 and the carbon fibers are mixed, or blending the abrasive grains 66 and the carbon fibers in a raw material for the felt in a manufacturing process of the felt. By impregnating the felt with a liquid adhesive (an epoxy resin-based adhesive, a phenol resin-based adhesive, or the like), the polishing layer 62 with the abrasive grains 66 and the carbon fibers dispersed in the binder layer 64 made of the felt is formed. As an alternative, a polishing layer 62 with the abrasive grains 66 and the carbon fibers dispersed in a binder layer 64 made from a resin material is formed by conducting compression molding and firing after blending or kneading the resin material, the abrasive grains 66, and the carbon fibers.

Figure 5A:
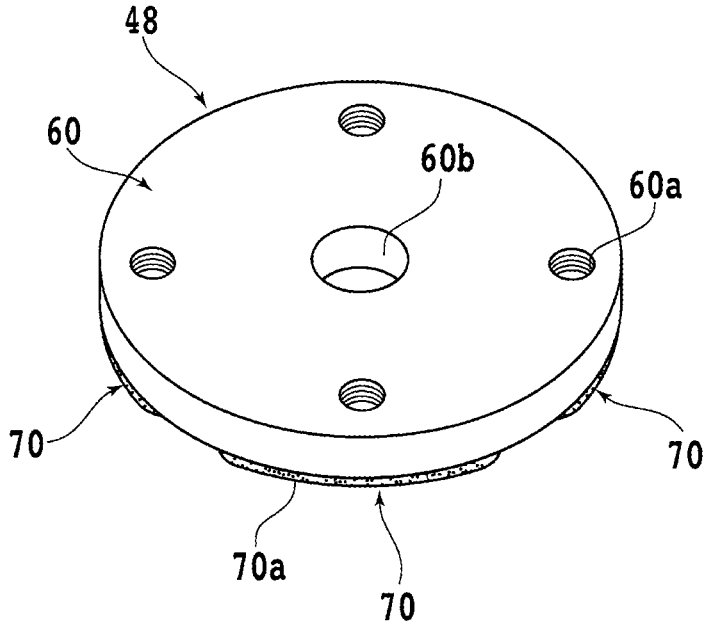
FIG. 5A is a perspective view illustrating a side of an upper surface of a polishing tool according to a modification of the embodiment, in which the polishing tool has a plurality of polishing layers.
Figure 5B:
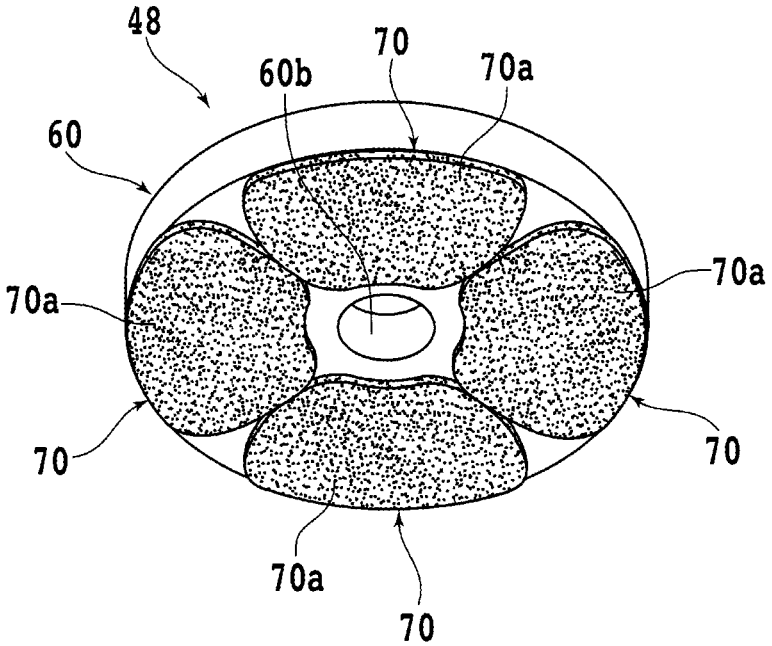
FIG. 5B is a perspective view illustrating a side of a bottom surface of the polishing tool of the modification of FIG. 5A.

It is to be noted that no limitations are imposed on the shape, number of divisions, and size of the polishing layer 62 to be fixed to the base 60. FIG. 5A is a perspective view illustrating a side of an upper surface of a polishing tool 48 according to a modification of the embodiment, in which the polishing tool 48 has a polishing layer divided into a plurality of parts, specifically, a plurality of polishing layers 70. FIG. 5B is a perspective view illustrating a side of a bottom surface of the polishing tool 48 of the modification, which has the plurality of polishing layers 70. As illustrated in FIGS. 5A and 5B, the polishing layers 70 may be fixed to the base 60. For example, four polishing layers 70 formed in a teardrop shape (petal shape) are arrayed at substantially equal intervals along the peripheral direction of the base 60. Lower surfaces of the polishing layers 70 constitute respective planar polishing surfaces 70*a* which are brought into contact with the wafer 11 to polish the wafer 11. It is to be noted that the polishing layers 70 have a similar configuration as that of the polishing layer 62 (see FIG. 4).

Figure 6:
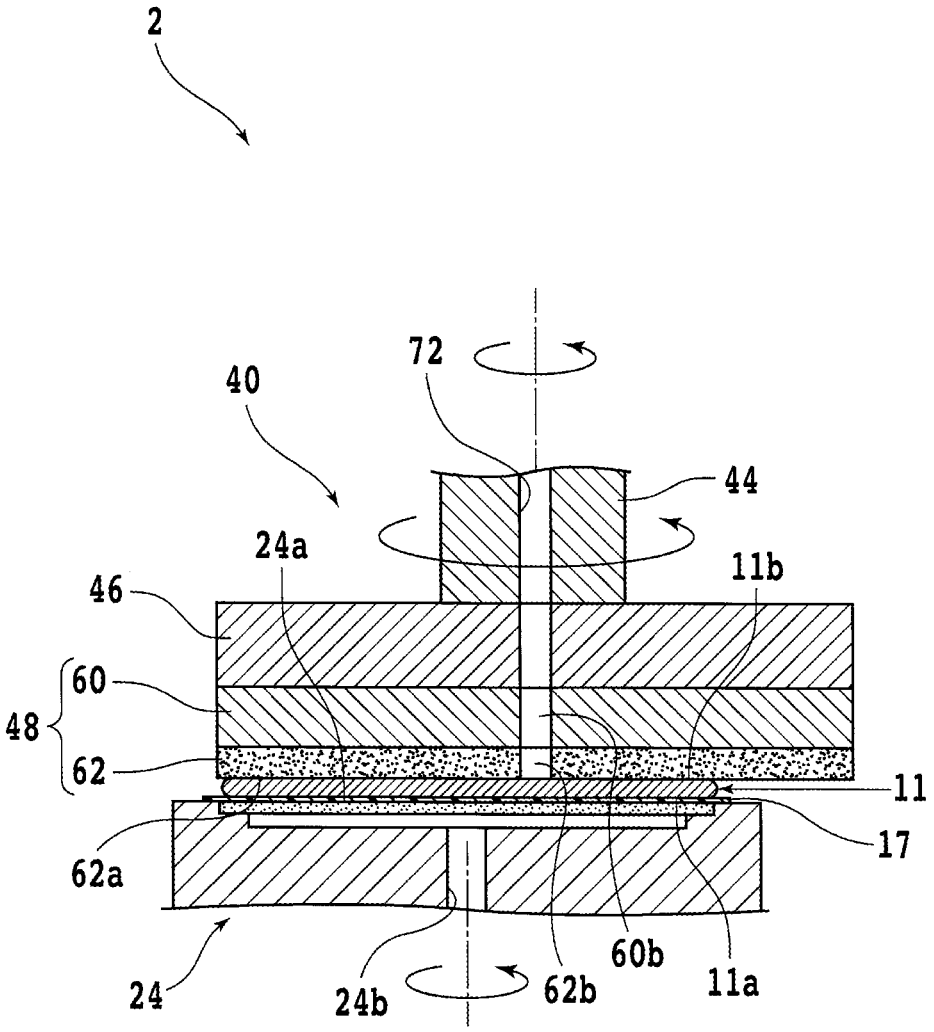
FIG. 6 is a fragmentary cross-sectional view illustrating the polishing apparatus of FIG. 1, which is polishing the wafer of FIG. 2 by the polishing tool of FIGS. 3A and 3B.

A description will next be made about a specific example of a method of polishing the wafer 11 by using the polishing tool 48. FIG. 6 is a fragmentary cross-sectional view illustrating the polishing apparatus 2 which is polishing the wafer 11.

When polishing the wafer 11 by the polishing tool 48, the polishing tool 48 is mounted on the polishing unit 40 of the polishing apparatus 2. Further, the wafer 11 is supported on the chuck table 24. Described specifically, the wafer 11 is placed on the chuck table 24 in such a manner that the side of the front surface 11*a* (the side of the protective member 17) faces the holding surface 24*a* and the side of the back surface 11*b* is exposed upward. When a suction force (negative pressure) of the suction source is caused to act on the holding surface 24*a* in this state, the wafer 11 is held under suction on the chuck table 24 via the protective member 17. The chuck table 24 with the wafer 11 held thereon is positioned underneath the polishing unit 40 by the moving mechanism 18 (see FIG. 1). At this time, the wafer 11 is located in such a position that its whole back surface 11*b* (its whole surface to be polished) overlaps the polishing surface 62*a* of the polishing layer 62.

The polishing unit 40 is next lowered by the moving mechanism 28 (see FIG. 1) while the chuck table 24 and the spindle 44 are being rotated. As a consequence, the rotating polishing layer 62 is pressed against the side of the back surface 11*b* of the wafer 11, so that the wafer 11 is polished on the side of the back surface 11*b* thereof by the polishing surface 62*a*. The wafer 11 is processed, for example, by dry polishing in which no polishing fluid is supplied to the wafer 11 and the polishing tool 48 during polishing. When the polishing unit 40 has been lowered to a predetermined position, the amount of polishing of the wafer 11 (the difference in the thickness of the wafer 11 between before and after the polishing) reaches a predetermined value, and the polishing of the wafer 11 is completed. As a result, the wafer 11 is planarized on the side of the back surface 11*b* thereof, and grinding marks remaining on the side of the back surface 11*b* of the wafer 11 are removed.

It is however to be noted that, when the wafer 11 is polished by the polishing tool 48, static electricity is generated between the wafer 11 and the polishing layer 62 which remain in contact with each other, so that the wafer 11 may be charged on the side of the polished surface (the side of the back surface lib) thereof. This charging of the wafer 11 may cause breakdowns and operational failures of the devices 15 (see FIG. 2) formed on the wafer 11.

As described above, the polishing tool 48 according to the embodiment includes the polishing layer (see FIG. 4) in which the electrically conductive material 68 is dispersed. When polishing the wafer 11 by the polishing tool 48, the electrically conductive material 68 which is exposed on the lower surface 64*b* of the binder layer 64 (the polishing surface 62*a*) comes into contact with the wafer 11. As a result, the wafer 11 is brought into contact with a ground terminal (not illustrated) via the electrically conductive material 68 dispersed in the polishing layer 62 as well as the bed 60, the mount 46, and the spindle 44 all of which are made of an electrically conductive metal. As a consequence, discharge paths are formed for static electricity generated between the wafer 11 and the polishing layer 62, so that the static electricity is eliminated from the wafer 11. It is to be noted that the electrically conductive material 68 is substantially uniformly dispersed throughout the polishing layer 62, and the amount of wear of the polishing layer 62 (the amount of decrease in the thickness of the polishing layer 62) during the polishing of the wafer 11 by the polishing tool 48 is substantially uniform throughout the polishing layer 62. In other words, the polishing surface 62*a* of the polishing layer 62 remains planar. As a consequence, the electrically conductive material 68 exposed on the polishing surface 62*a* of the polishing layer 62 remains in contact with the wafer 11, and therefore, long-lasting static electricity eliminating effect is ensured.

As described above, the polishing tool 48 according to the embodiment includes the polishing layer 62 with the electrically conductive material 68 dispersed therein. When polishing the wafer 11 by the polishing tool 48, the electrically conductive material 68 therefore remains in contact with the wafer 11, so that the elimination of static electricity generated between the wafer 11 and the polishing layer 62 is ensured.

In the embodiment, the description is made about the case in which the wafer 11 is polished by dry polishing. However, the wafer 11 can also be polished by wet polishing. If this is the case, when polishing the wafer 11 by the polishing tool 48, a polishing fluid is supplied to the wafer 11 and the polishing tool 48 from a polishing fluid supply channel 72 (see FIG. 6), which is formed inside the polishing unit 40, via the through-holes 60*b* and 62*b*. A usable example of the polishing fluid can be an alkaline solution containing sodium hydroxide, potassium hydroxide, or the like, an acidic solution containing a permanganic salt, pure water, or the like.

Moreover, the construction, method, and the like according to the above-described embodiment can be practiced with various modifications made within the scope not departing from the object of the present invention.

Example 1

A description will next be made about results of evaluation of a characteristic of a polishing tool according to the present invention. In this Example, nine substrates 21 of different contents of carbon fibers were prepared as substrates for evaluation, which corresponded to the polishing layer 62 (see FIG. 4) of the polishing tool 48, and were each measured for resistance value.

Figure 7A:
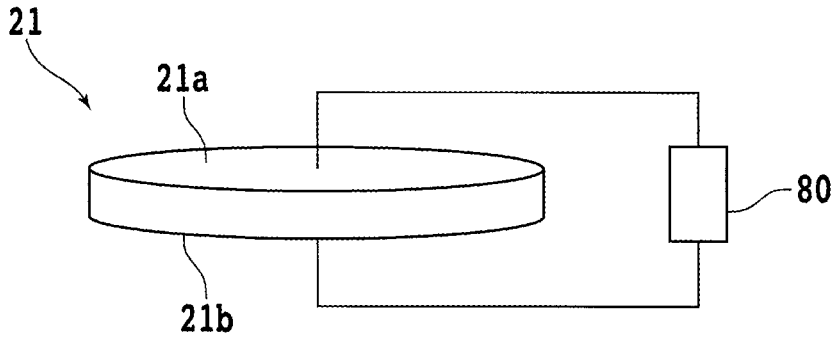
FIG. 7A is a diagram illustrating a substrate for evaluation, and a measurement circuit for its resistance value, in Example 1.

FIG. 7A is a diagram illustrating one of the substrates 21, and a measurement circuit for its resistance value, in Example 1. The substrate 21 was formed in a manner similar to that of the polishing layer (see FIG. 4). Described specifically, the substrate 21 was formed in a disc shape by dispersing abrasive grains and a conductive material in a binder (rubber particles). As the abrasive grains, silica having an average grain size of 5 μm was used, and as the conductive material, carbon fibers having an average fiber length of 10 μm and an average fiber diameter of 0.2 μm were used. The substrate 21 had a diameter set to 150 mm and a thickness set to 10 mm.

The contents of the carbon fibers in the individual substrates 21 were adjusted to 0 wt %, 1.0 wt %, 2.0 wt %, 3.0 wt %, 3.5 wt %, 4.0 wt %, 4.5 wt %, 5.0 wt %, and 15.0 wt %. These contents are each equivalent to the proportion of the mass of the carbon fibers to the mass of the substrate 21 including the abrasive grains (the sum of the mass of the binder layer, the mass of the abrasive grains, and the mass of the carbon fibers). Each substrate 21 was then measured for its resistance value in the thickness direction. The resistance value was measured by bringing a probe of an ohmmeter (multimeter) 80 into contact with a front surface 21*a* and a back surface 21*b* of the substrate 21.

Figure 7B:
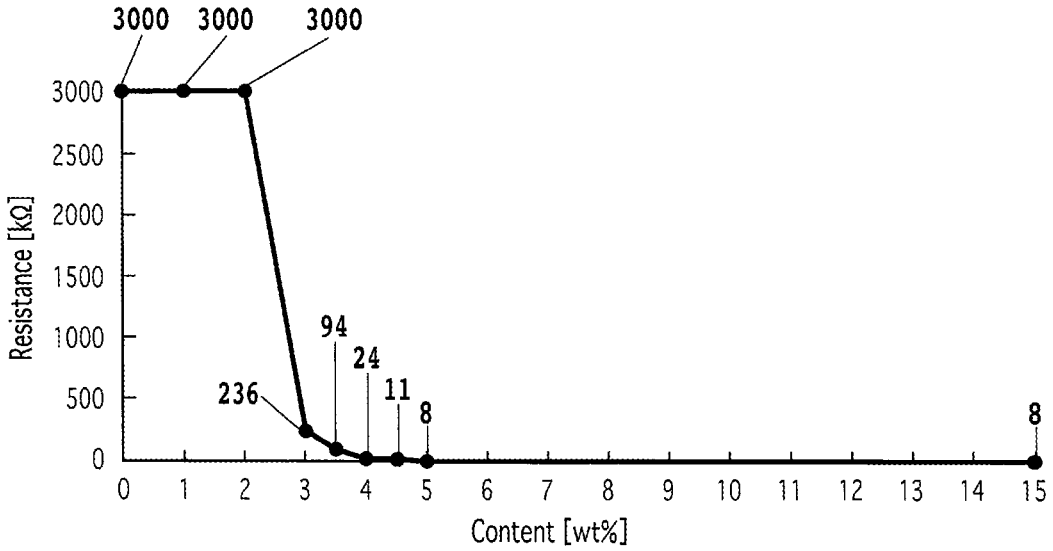
FIG. 7B is a graph illustrating a relation between the content of carbon fibers and the resistance value of the substrate for evaluation in Example 1.

FIG. 7B is a graph illustrating a relation between the content of carbon fibers and the resistance value of the substrate 21 for evaluation. The resistance values of the substrates 21 in which the contents of the carbon fibers were 0 wt %, 1.0 wt %, and 2.0 wt % were 3,000 kΩ, which is the upper limit of measurement by the ohmmeter 80, or higher. If the content of the carbon fibers reached 3.0 wt %, on the other hand, the resistance value of the substrate 21 sharply decreased to 236 kΩ. This is presumed to be attributable to facilitation of formation of electrically conductive paths from the front surface 21*a* to the back surface 21*b* of the substrate 21 owing to the increase of the carbon fibers contained in the substrate 21. Accordingly, the preferred content of the carbon fibers in the polishing layer 62 (see FIG. 4) has been confirmed to be 3.0 wt % or more.

Further, the resistance value of the substrate 21 decreased to 94 kΩ, 24 kΩ, 11 kΩ, and 8 kΩ as the content of the carbon fibers reached 3.5 wt %, 4.0 wt %, 4.5 wt %, and 5.0 wt %. Therefore, the content of the carbon fibers in the polishing layer 62 (see FIG. 4) has been confirmed to be preferably 3.5 wt % or more, more preferably 4.0 wt % or more, still more preferably 4.5 wt % or more, or even still more preferably 5.0 wt % or more. Furthermore, the resistance value of the substrate 21 decreased to 8 kΩ, the lowest, when the content of the carbon fibers was 5.0 wt % and 15.0 wt %.

When the content of the carbon fibers exceeded 15.0 wt %, however, the substrate 21 was confirmed to be embrittled and reduced in mechanical strength although its resistance value remained low. In order to polish the wafer 11 while maintaining the polishing layer 62 (see FIG. 4) in its desired molded shape, the content of the carbon fibers is hence preferably 15.0 wt % or less.

From the results described above, the inclusion of carbon fibers in the polishing layer 62 (see FIG. 4) of the polishing tool 48 has been confirmed to make it possible to lower the resistance value of the polishing layer 62 in the thickness direction thereof and to develop electrical conductivity effective for eliminating static electricity.

Example 2

A description will next be made about results of polishing of a wafer by the polishing tool according to the present invention. In this Example, charging of the wafer during polishing was monitored by measuring a voltage on the front surface of the wafer while polishing the wafer by a polishing tool 48.

Figure 8A:
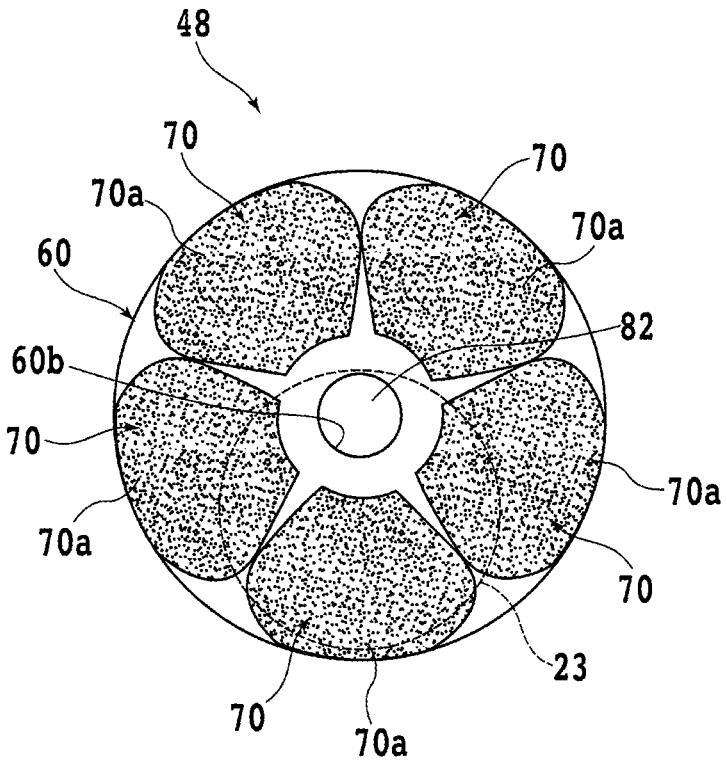
FIG. 8A is a bottom view illustrating a polishing tool used for polishing a wafer in Example 2.

FIG. 8A is a bottom view illustrating the polishing tool 48 used for polishing the wafer. The polishing tool 48 illustrated in FIG. 8A had a similar configuration as that of the polishing tool 48 illustrated in FIGS. 5A and 5B except the number of polishing layers 70 was five. The base 60 had a diameter set to 450 mm, and the five teardrop-shaped (petal-shaped) polishing layers 70 had a thickness set to 10 mm. Further, the polishing layers 70 were formed by dispersing abrasive grains and an electrically conductive material in a binder (rubber particles). As the abrasive grains, silica having an average grain size of 5 μm was used, and as the electrically conductive material, carbon fibers having an average fiber length of 10 μm and an average fiber diameter of 0.2 μm were used. Further, the content of the carbon fibers was adjusted to 5 wt %.

Figure 8B:
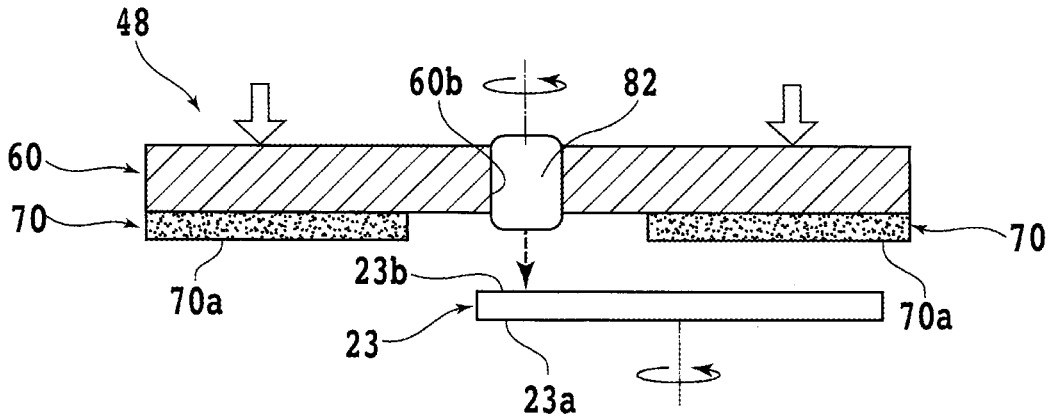
FIG. 8B is a partially cross-sectional front view illustrating the polishing tool of FIG. 8A.

The above-described polishing tool 48 was then mounted on the polishing unit 40 (see FIG. 1) of the polishing apparatus 2, and a wafer 23 (see FIG. 8B) was polished by the polishing tool 48. FIG. 8B is a partially cross-sectional front view illustrating the polishing tool 48 used for polishing the wafer 23. As the wafer 23, a silicon wafer of 300 mm diameter and 100 μm thickness was used. The wafer 23 was held on a side of a front surface 23*a* thereof under suction on the chuck table 24 (see FIG. 6) and was polished on a side of a back surface 23*b* thereof by the polishing layers 70. It is to be noted that a rotational speed of the chuck table (see FIG. 6) was set to 100 rpm, a rotational speed of the spindle 44 (see FIG. 6) was set to 1,000 rpm, and a lowering speed of the polishing tool 48 was adjusted to apply a load of 200 N on the wafer 23.

Under the above-described polishing conditions, 48 wafers 23 were polished each for 220 seconds by dry polishing. During the polishing of each wafer 23, the voltage on the back surface 23*b* of the wafer 23 was measured using a contactless voltage measurement sensor 82. The contactless voltage measurement sensor 82 was arranged in a central part of the base 60 of the polishing tool 48, and the voltage in a region on the back surface 23*b* of the wafer 23, the region being positioned right underneath the voltage measurement sensor 82, was measured. During the polishing of all the 48 wafers 23, the voltages so measured were in a range of −50 V or higher but 50 V or lower and remained substantially constant. In other words, neither an increase nor a decrease in voltage due to charging of the wafers 23 was confirmed. This is presumed to be attributable to the elimination of static electricity which was generated between the wafers 23 and the polishing layers 70 during the polishing by the carbon fibers included in the polishing layers 70.

From the results described above, the inclusion of carbon fibers in the polishing layer 70 of the polishing tool 48 has been confirmed to effectively prevent charging of the wafers 23.

The present invention is not limited to the details of the above-described preferred embodiment. The scope of the invention is defined by the appended claims and all changes and modifications as fall within the equivalence of the scope of the claims are therefore to be embraced by the invention.

What is claimed is:

1. A polishing tool for polishing a wafer, comprising:

a disc-shaped base that is configured and arranged to be rotated; and a polishing layer fixed to the disc-shaped base, wherein the polishing layer includes an electrically conductive material that is dispersed throughout an entirety of the polishing layer to eliminate static electricity generated when the polishing layer comes into contact with the wafer, wherein the electrically conductive material comprises carbon fiber, and the carbon fiber is included at a content of 3 wt % or more but 15 wt % or less, and wherein a portion of the electrically conductive material is exposed on an upper surface of the polishing layer, a portion of the electrically conductive material is exposed on a lower surface of the polishing layer, and the electrically conductive material within the polishing layer forms an electrically conductive path between the portion of the electrically conductive material exposed on the upper surface of the polishing layer and the portion of the electrically conductive material exposed on the lower surface of the polishing layer, and wherein an outer diameter of the upper surface of the polishing layer and an outer diameter of the lower surface of the polishing layer are both substantially the same as an outer diameter of the disc-shaped base.

2. The polishing tool according to claim 1, wherein the polishing layer also comprises:

a binder layer; and abrasive grains, wherein the abrasive grains and the electrically conductive material are both contained in the binder layer.

3. The polishing tool according to claim 2, wherein the abrasive grains comprise silica of an average grain size of between 1 μm and 10 μm.

4. The polishing tool according to claim 1, wherein the carbon fibers have an average fiber length of between 1 μm and 20 μm and an average fiber diameter of between 0.1 μm and 0.5 μm.

5. The polishing tool according to claim 1, wherein the polishing layer is disc-shaped.

6. The polishing tool according to claim 1, wherein the electrically conductive material is substantially uniformly dispersed throughout the polishing layer.

7. A polishing tool for polishing a wafer, comprising:

a disc-shaped base that is configured and arranged to be rotated; and a polishing layer fixed to the disc-shaped base, wherein the polishing layer includes an electrically conductive material that is dispersed as fibers throughout an entirety of the polishing layer to eliminate static electricity generated when the polishing layer comes into contact with the wafer, and wherein the electrically conductive material is included at a content such that a portion of the electrically conductive material is exposed on an upper surface of the polishing layer, a portion of the electrically conductive material is exposed on a lower surface of the polishing layer, and the electrically conductive material within the polishing layer forms an electrically conductive path between the portion of the electrically conductive material exposed on the upper surface of the polishing layer and the portion of the electrically conductive material exposed on the lower surface of the polishing layer, and wherein an outer diameter of the upper surface of the polishing layer and an outer diameter of the lower surface of the polishing layer are both substantially the same as an outer diameter of the disc-shaped base.

8. The polishing tool according to claim 7, wherein the electrically conductive material comprises carbon fiber, and the carbon fiber is included at a content of more than 5 wt % but less than 15 wt %.

9. The polishing tool according to claim 8, wherein the carbon fibers have an average fiber length of between 1 μm and 20 μm and an average fiber diameter of between 0.1 μm and 0.5 μm.

10. The polishing tool according to claim 7, wherein the electrically conductive material comprises carbon fiber, and the carbon fiber is included at a content of between 10 wt % and 15 wt %, inclusive.

11. The polishing tool according to claim 7, wherein the polishing layer also comprises:

a binder layer; and abrasive grains, wherein the abrasive grains and the electrically conductive material are both contained in the binder layer.

12. The polishing tool according to claim 11, wherein the abrasive grains comprise silica of an average grain size of between 1 μm and 10 μm.

13. The polishing tool according to claim 7, wherein the electrically conductive material is substantially uniformly dispersed throughout the polishing layer.

14. A polishing unit for polishing a wafer, comprising:

a spindle configured and arranged for rotation about a central axis thereof;

a disc-shaped mount fixed for rotation with the spindle; and a polishing tool that includes a disc-shaped base that is configured and arranged to be rotated with the spindle and the disc-shaped mount, and a polishing layer fixed to the disc-shaped base;

wherein the polishing layer includes an electrically conductive material that is dispersed as fibers throughout an entirety of the polishing layer to eliminate static electricity generated when the polishing layer comes into contact with the wafer, wherein a portion of the electrically conductive material is exposed on an upper surface of the polishing layer, a portion of the electrically conductive material is exposed on a lower surface of the polishing layer, and the electrically conductive material within the polishing layer forms an electrically conductive path between the portion of the electrically conductive material exposed on the upper surface of the polishing layer and the portion of the electrically conductive material exposed on the lower surface of the polishing layer, wherein the spindle, the disc-shaped mount and the disc-shaped base are each made of an electrically conductive metal such that when the polishing layer comes into contact with the wafer, a discharge path is formed for the static electricity from the wafer, via the electrically conductive material of the polishing layer, the disc-shaped base, the disc-shaped mount and the spindle, and wherein an outer diameter of the upper surface of the polishing layer and an outer diameter of the lower surface of the polishing layer are both substantially the same as an outer diameter of the disc-shaped base.

15. The polishing unit according to claim 14, wherein the electrically conductive material comprises carbon fiber, and the carbon fiber is included at a content of more than 5 wt % but less than 15 wt %.

16. The polishing unit according to claim 15, wherein the carbon fibers have an average fiber length of between 1 μm and 20 μm and an average fiber diameter of between 0.1 μm and 0.5 μm.

17. The polishing unit according to claim 14, wherein the polishing layer also comprises:

a binder layer; and abrasive grains, wherein the abrasive grains and the electrically conductive material are both contained in the binder layer.

18. The polishing unit according to claim 17, wherein the abrasive grains comprise silica of an average grain size of between 1 μm and 10 μm.

19. The polishing tool according to claim 14, wherein the electrically conductive material is substantially uniformly dispersed throughout the polishing layer.

* * * * *